US005502351A

United States Patent [19]

Katoh et al.

[11] Patent Number: 5,502,351

[45] Date of Patent: Mar. 26, 1996

[54] SPARK PLUG HAVING HORIZONTAL DISCHARGE GAP

[75] Inventors: Akio Katoh, Nishio; Nobuo Abe, Yokkaichi, both of Japan

[73] Assignee: Nippondenso Co., Ltd., Kariya, Japan

[21] Appl. No.: 224,975

[22] Filed: Apr. 8, 1994

[30] Foreign Application Priority Data

Apr. 28, 1993 [JP] Japan ..... 5-125553

[51] Int. Cl.[6] ..... H01T 13/20

[52] U.S. Cl. ..... 313/141; 313/118

[58] Field of Search ..... 313/141, 118; 445/7, 49

[56] References Cited

U.S. PATENT DOCUMENTS

| | | | |
|---|---|---|---|
| 2,391,456 | 12/1945 | Hensel | 313/141 |
| 4,329,615 | 5/1982 | Tanaka et al. . | |
| 4,465,952 | 8/1984 | Sato et al. | 313/141 |
| 4,540,910 | 9/1985 | Kondo et al. . | |
| 4,904,216 | 2/1990 | Kagawa et al. . | |
| 4,970,426 | 11/1990 | Bronchart | 313/141 |
| 5,051,651 | 9/1991 | Kashiwara et al. | 313/141 |
| 5,239,225 | 8/1993 | Moriya et al. | 313/141 |

FOREIGN PATENT DOCUMENTS

| | | | |
|---|---|---|---|
| 428892 | 5/1935 | European Pat. Off. . | |
| 710198 | 6/1954 | European Pat. Off. . | |
| 62-31797 | 4/1985 | Japan . | |
| 3-50396 | 11/1985 | Japan . | |
| 61-230282 | 10/1986 | Japan | 313/141 |
| 5-114455 | 5/1993 | Japan . | |

*Primary Examiner*—Sandra L. O'Shea
*Assistant Examiner*—Matthew J. Esserman
*Attorney, Agent, or Firm*—Cushman, Darby & Cushman

[57] ABSTRACT

The tip 10 of the center electrode 1 is opposed to the ground electrodes 21 and 22. The tip 10 has flat faces 111 and 121 opposed to the discharge faces of the ground electrodes 211 and 221, and inclined faces 101 and 102 extending from the flat faces to the base 19. The flat faces have noble metal pieces 31 and 32 at positions opposed to the discharge faces. The discharge faces have a spark gap G between itself and the noble metal piece, a minimum gap A between itself and the inclined face, and a minimum gap B between itself and the tip face 41 of the insulator 4. The spark gap G, minimum gap A, and minimum gap B are related such that the distance of A≧1.2×the distance of G, and the distance of B≧the distance G. The axial length L of the flat face and the area S of a cross section perpendicular to the flat face should, preferably, have the relation S/L≧0.7.

10 Claims, 10 Drawing Sheets

PRIOR ART

PRIOR ART

PRIOR ART

SPARK PLUG HAVING HORIZONTAL DISCHARGE GAP

BACKGROUND OF THE INVENTION

1. Field of the Invention

The present invention relates to a spark plug wherein a noble metal piece attached to a center electrode and a discharge face of a ground electrode are opposed to each other.

2. Description of Related Art

Recently, the attaching and detaching of spark plugs in automotive internal combustion engines are becoming difficult due to the increase of accessories, which gives rises to the need for more durable spark plugs that reduces or completely eliminates detaching works.

Also, the recent trend toward energy conservation asks for automotive internal combustion engines with better fuel economy and leaner burn, which necessitates spark plugs with higher ignition performance.

A conventional example to solve these problems is the spark plug shown in FIGS. 13 through 15 (Japanese Patent Examined Publication No.62-31797).

This spark plug has a center electrode 1 and ground electrodes 21 and 22 which are opposed to the tip 10 of the center electrode 1. The tip 10 of the center electrode 1 has a noble metal disk 3 at a position opposed to the spark points 219 and 229 of the ground electrodes 21 and 22.

The base 19 of the center electrode 1 is inserted and secured in the cavity of an insulator 4. The insulator 4 is inserted and secured in the cavity of the metallic housing 5, on which the ground electrodes 21 and 22 are formed. Sparks are induced at the spark gaps between the noble metal disk 3 and the spark points 219 and 229.

In the above spark plug, the contact area between the center electrode 1 and the noble metal ring 3 is large because the tip 10 of the center electrode 1 has a noble ring 3 over its entire circumference. Therefore, a heat stress is caused between the tip 10 of the center electrode 1 and the noble metal ring 3 due to the difference in the thermal expansion of the electrode material that forms the center electrode 1 and the noble metal that forms the noble metal ring 3.

This may cause a crack, peeling or fall of the noble metal ring 3. The peeled noble metal ring may even short-circuit the spark gap. Therefore, the spark plug can not obtain a prolonged service life in spite of utilizing the noble metal piece.

Another conventional example is the spark plug shown in FIG. 16 (Japanese Patent Examined Publication No.3-50396). This spark plug has an external electrode 25, a center electrode 1 having an aerial discharge gap Y between itself and the external electrode 25, an insulator 45 in which the center electrode 1 is inserted and secured, and a metallic part 55 which secures the base 46 of the insulator 45.

A noble metal part 30 is connected to the tip 10 of the center electrode 1. The tip 47 of the insulator 45 protrudes from the insulator 45 has a small diameter portion 471 with a smaller diameter than that of the base 46.

A gap Z exists between the spark point 26 of the external electrode 25 and the small diameter portion 471 of the insulator 45.

This spark plug is installed with a 14 mm thread.

However, the gap Z between the spark point 26 and the insulator 45 is designed to be about half the aerial discharge gap Y. Therefore, sparks may occur even at the gap Z if an engine having these spark plugs is initiated, when carbon or other matter adheres to the small diameter portion 471 of the insulator 45, or when the spark voltage at the aerial discharge gap Y increases depending on the engine operating conditions.

Therefore, a flame seed produced at the gap Z, which is narrower in effect, is more easily extinguished than that produced at the aerial discharge gap Y.

Also, the gap Z is not easily accessible to air-fuel mixture because it is surrounded by the external electrode 25 and the insulator 45. Furthermore, a spark at the gap Z less easily spreads to the rest of the combustion chamber than that at the aerial discharge gap Y, because the gap Z is located more distantly from the center of the combustion chamber than the aerial discharge gap Y when the spark plug is installed in the combustion chamber.

For these reasons, a spark at the gap Z not only shows very low ignition performance, but occurs frequently under ordinary engine operating conditions. Therefore, the ignition performance of the above spark plug remains insufficient.

SUMMARY OF THE INVENTION

The present invention attempts to provide a spark plug with a longer life and a higher ignition performance.

The present invention relates to a spark plug wherein an insulator is inserted and secured in the cavity of a metallic housing having a ground electrode, and the base of a center electrode is inserted and secured in the cavity of the insulator, the tip of the center electrode and the ground electrode opposed to each other, the tip of the center electrode having a flat face opposed to the discharge face of the ground electrode, and a connecting portion extending from the flat face toward the base, the flat face having a noble metal piece at a position opposed to the discharge face of the ground electrode, the discharge face of the ground electrode having a spark gap G between itself and the noble metal piece, a minimum gap A between itself and the inclined face, and a minimum gap B between itself and the tip face of the insulator, wherein spark occurs at the gap G and no spark occurs at the gaps A and B.

In one preferred mode, the spark gap G, minimum gap A, and minimum gap B having relations that a distance of $A \geqq 1.2 \times a$ distance of G, and a distance of $B \geqq a$ distance of G.

In the present invention, the discharge face of the ground electrode has a spark gap G between itself and the noble metal piece, a minimum gap A between itself and the connecting portion, and a minimum gap B between itself and the tip face of the insulator. The spark gap G, minimum gap A, and minimum gap B have relations that a distance of $A \geqq 1.2 \times a$ distance of G, and a distance of $B \geqq a$ distance of G.

When a distance of $A < 1.2 \times a$ distance of G, a spark is likely between the discharge face of the ground electrode and the connecting portion (see FIG. 7).

When a distance of $B < a$ distance of G, the air-fuel ratio for optimum combustion of the combustion engine decreases (see fourth embodiment), requiring a richer air-fuel mixture.

In another preferred mode, the axial length L of the flat face of the above center electrode and the area S of a cross section perpendicular to the above flat face should, preferably, have the relation $S/L \geqq 0.7$ (see FIG. 10).

When $S/L < 0.7$, oxidation may occur on the contact surface between the noble metal piece and the flat face, resulting in a possible peeling of the noble metal piece.

The center electrode has one or more flat faces at its end, which are planes parallel to the axis of the center electrode and opposed to the discharge face of the ground electrode.

A noble metal piece is attached to the flat face only at the position opposed to the discharge face. The noble metal piece is a flat piece such as a disk or a square plate.

The noble metal piece contains an amount of noble metal corresponding to the life of the spark plug, such as Pt-Ir-Ni alloy, Pt-Ir alloy, Pt-Ni, Pt-Ag, pure platinum, Pt-W, Pt-Ru-Pd.

The discharge face of the ground electrode should preferably be parallel to the surface of the noble metal piece in order to assure stable spark.

In the spark plug of the present invention, the spark gap G between the discharge face of the ground electrode and the noble metal piece, and the minimum gap A between the discharge face and the connecting portion of the center electrode have the relation that a distance of $A \geqq 1.2 \times$a distance of G. Therefore, spark hardly occurs at the minimum gap A, maximizing the frequency of spark at the spark gap G (see FIG. 7).

Also, a high ignition performance is ensured with lean air-fuel mixtures.

The spark gap G and the minimum gap B between the discharge face of the ground electrode and the tip of the insulator have the relation a distance of $B \geqq$a distance of G. This eliminates the possibility of spark at the minimum gap B. Furthermore, even if carbon or other matter adheres to the tip of the insulator, spark is not possible at the minimum gap B. Thus, spark frequency is high at the spark gap G between the discharge face and the most closely located noble metal piece.

Also, the spark gap is easily accessible to air-fuel mixture because the spark gap G is positioned close to the tip of the center electrode, helping spread the flame seed produced at the spark gap.

When the spark plug of the present invention is installed in a combustion chamber, the tip of the center electrode is directed to the center of the combustion chamber. Therefore, spark at the spark gap G easily spread the resulting flame to the rest of the combustion chamber.

Thus, an increased spark frequency at the spark gap G improves the ignition performance of the spark plug.

In addition, a flat noble metal piece is attached to the flat face of the center electrode. Therefore, the noble piece contacts the flat face in a plane, assuring uniform and secure contact over the entire contact surfaces of these parts.

The noble metal piece is attached only at the position where spark occurs between the ground electrode and the center electrode. Therefore, the most severely used portion of the center electrode is protected by the noble metal piece, preventing the deterioration of the center electrode and, thus, prolonging the life of the spark plug.

Also, the noble metal piece contains an amount of noble metal corresponding to the life of the spark plug, enabling to make the most use of the minimum amount of noble metal.

As explained above, the present invention provides a spark plug with a longer life and a higher ignition performance.

DETAILED DESCRIPTION OF THE EMBODIMENTS

FIRST EMBODIMENT

A spark plug of the present invention is explained in FIGS. 1 through 5.

Figure 1:
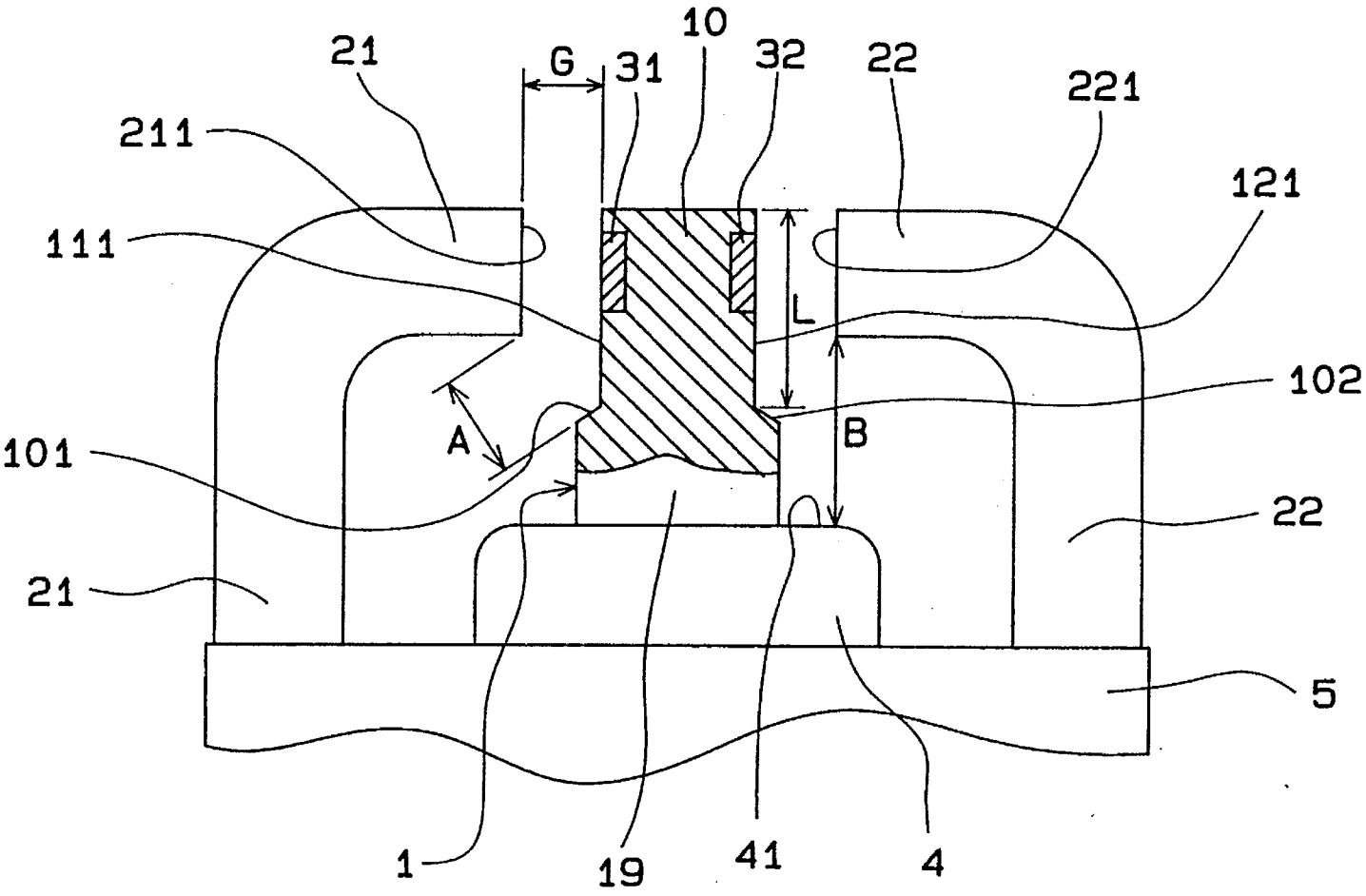
FIG. 1 is a partially cross sectional side view of the principal part of a spark plug of a first embodiment of the present invention.

In the spark plug of this embodiment, an insulator 4 is inserted and secured in the cavity of a metallic housing 5, which has ground electrodes 21 and 22, as shown in FIG. 1. The base 19 of a center electrode 1 is inserted and secured in the cavity of the insulator 4. The tip 10 of the center electrode 1 and the ground electrodes 21 and 22 are opposed to each other.

Figure 2:
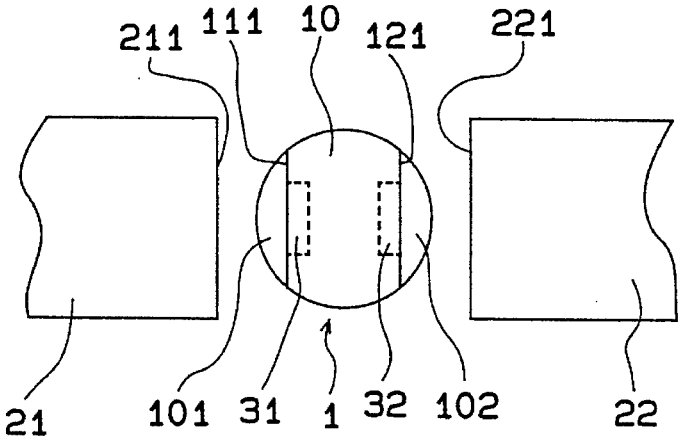
FIG. 2 is a plan view of the spark plug in FIG. 1.
Figure 3:
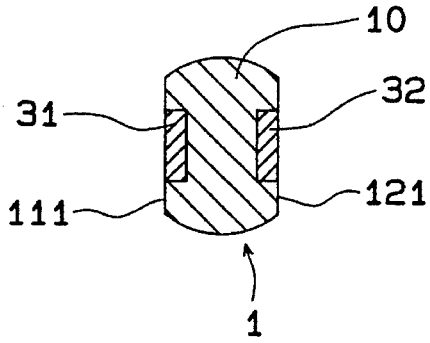
FIG. 3 is a cross sectional view of a center electrode at the place of including noble metal pieces in FIG. 1.
Figure 4:
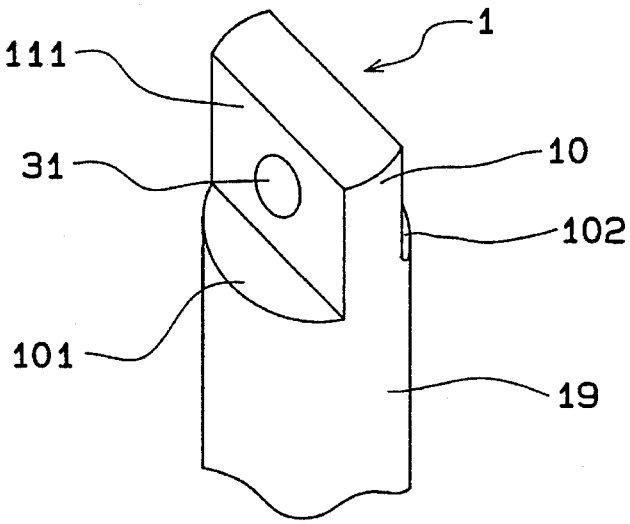
FIG. 4 is a perspective view of the principal part of the center electrode in FIG. 1.

As shown in FIGS. 2 through 4, the tip 10 of the above center electrode 1 has flat faces 111 and 121, which are opposed to the discharge faces 211 and 221 of the ground electrodes 21 and 22, and connecting portions consisting of two inclined faces 101 and 102 in this case, which extend from the flat faces 111 and 121 toward the base 19.

noble metal pieces 31 and 32 are attached to the flat faces 111 and 121 at the positions opposed to the discharge faces 211 and 221 of the ground electrodes 21 and 22.

As shown in FIG. 1, the discharge faces 211 and 221 of the ground electrodes 21 and 22 have a spark gap G between themselves and the noble metal pieces 31 and 32, a minimum gap A between themselves and the inclined faces 101 and 102, and a minimum gap B between themselves and the tip face 41 of the insulator 4. The spark gap G, minimum gap A, and minimum gap B have relations that a distance of A≧1.2 ×a distance of G, and a distance of B≧a distance of G.

An axial length L of the flat faces 111 and 121 of the center electrode 1 and the area S of a cross section perpendicular to the flat faces 111 and 121 have a relation S/L≧0.7.

The flat faces 111 and 121 are planes parallel to the axis of the center electrode 1 and opposed to the discharge faces 211 and 221 of the ground electrodes 21 and 22. Noble metal pieces 31 and 32 are resistance-welded to the flat faces 111 and 121 only at the positions opposed to the discharge faces 211 and 221. The surface of the noble metal pieces 31 and 32 are formed parallel to the discharge faces 211 and 221 of the ground electrodes 21 and 22 in order to produce stable sparks.

The noble metal pieces 31 and 32 are disks with a diameter of 1.0 mm and a thickness of 0.4 mm. The noble metal pieces 31 and 32 contain an amount of noble metal 78 wt % Pt- 20 wt % Ir-2 wt % Ni alloy - corresponding to the required life of the spark plug.

The diameter of the center electrode 1, except for the flat faces 111 and 121 diameter portion , is 2.5 mm. The center electrode 1 is formed of heat-resistant Ni alloy. The ground electrodes 21 and 22 are formed of heat-resistant Ni alloy. The insulator 4 is formed of conventional sintered alumina.

Figure 5:
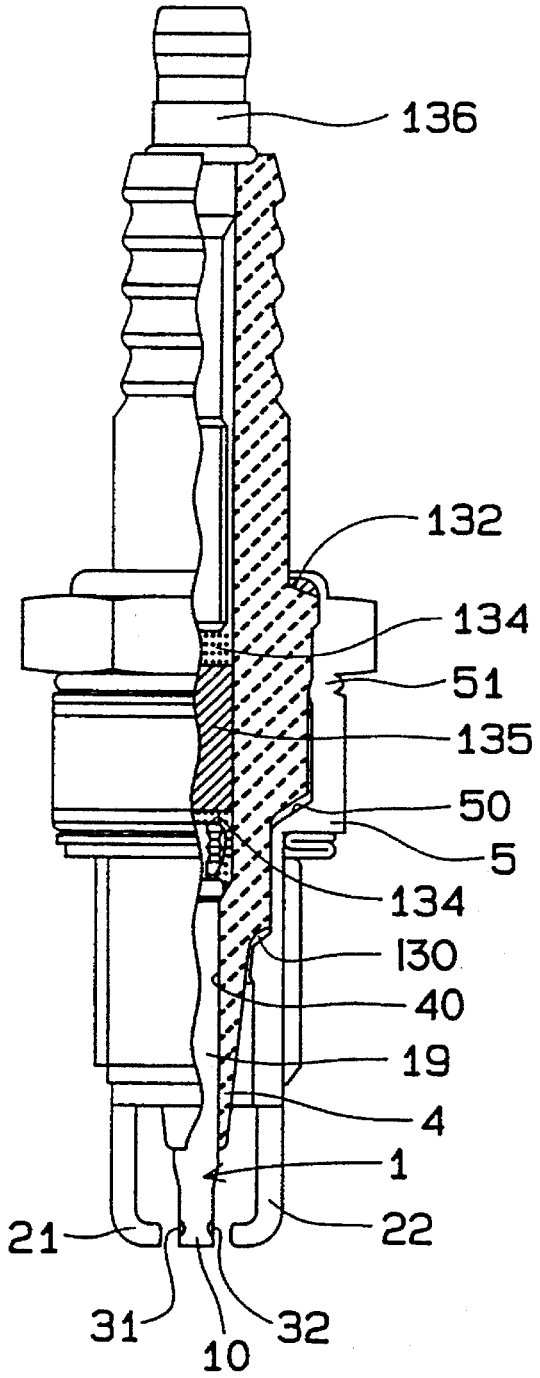
FIG. 5 is a partially cross sectional side view of the spark plug in FIG. 1.

In the spark plug of this embodiment, as shown in FIG. 5, an internal resistor 135 and a terminal 136 are inserted and secured in the cavity 40 of the insulator 4, in addition to the base 19 of the center electrode 1. Also, conductive glass 134 is fused and affixed between the center electrode 1 and the internal resistor 135.

Gaskets 130 and 132 are inserted in such a manner to obtain air-tightness between the glass 4 and the metallic housing 5. The glass 4 is secured by crimping the middle section 51 of the metallic housing 5.

SECOND EMBODIMENT

In this embodiment, the relation between the ratio (A/G) of the minimum gap A to the spark gap G and the spark frequency was analyzed.

The spark plug according to the first embodiment was installed in a pressure chamber. The pressure chamber was pressurized to 7 kg/cm$^2$ with air. Under this condition, the spark plug discharges at the same voltage as in an automotive engine. The spark plug was discharged by using a ordinal power supply for automotive ignition.

Figure 6:
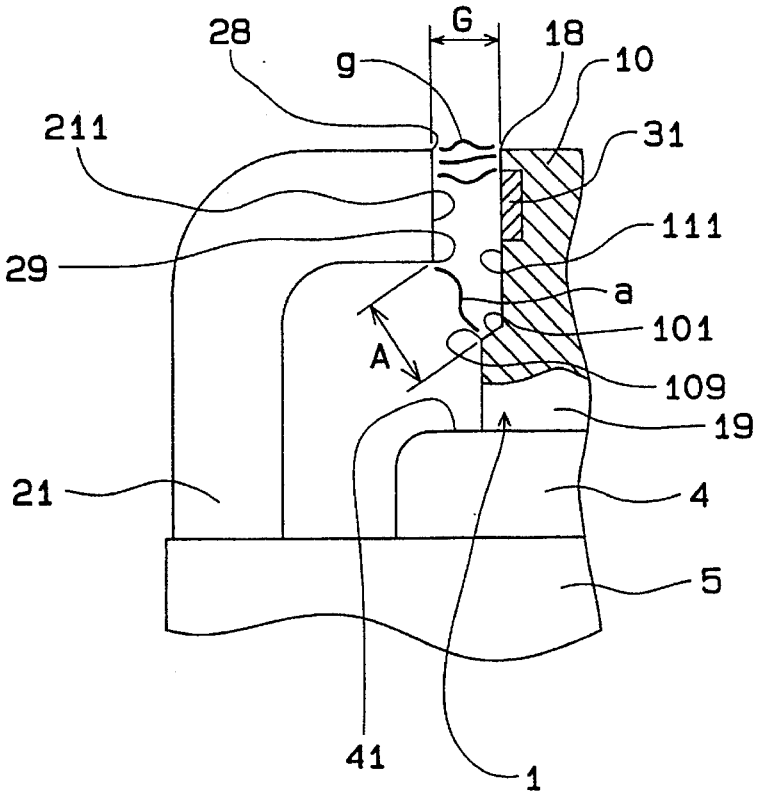
FIG. 6 is a schematic diagram showing spark positions in a partially cutaway view of a second embodiment.

When the spark plug was discharged with the varied value of A/G, as shown in FIG. 6, spark g occurred at the spark gap G. Spark a also occurred at the minimum gap A between the discharge face 211 of the ground electrode 21 and the inclined face 101 of the center electrode 1.

The occurrence of the spark g is attributed to the intense electric field at the top of 18 of the flat face 111 and the top 28 of the discharge face 211 due to the pointed shapes of the tops 18 and 28.

The occurrence of the spark is also attributed to the intense electric field at the bottom of 109 of the inclined face 101 and the bottom 29 of the discharge face 211 due to the pointed shapes of the tops 18 and 28.

No spark occurred at the minimum gap B between the discharge face 211 of the ground electrode 21 and the tip face 41 of the insulator 4.

Then, the frequency of spark g and the frequency of spark a were measured in such a manner to vary the ratio A/G. The frequency was expressed as each spark's percentage (%) of a number of sparks a and g relative to 1000 sparks produced between the discharge face 211 and the tip 10 of the center electrode 1.

Figure 7:
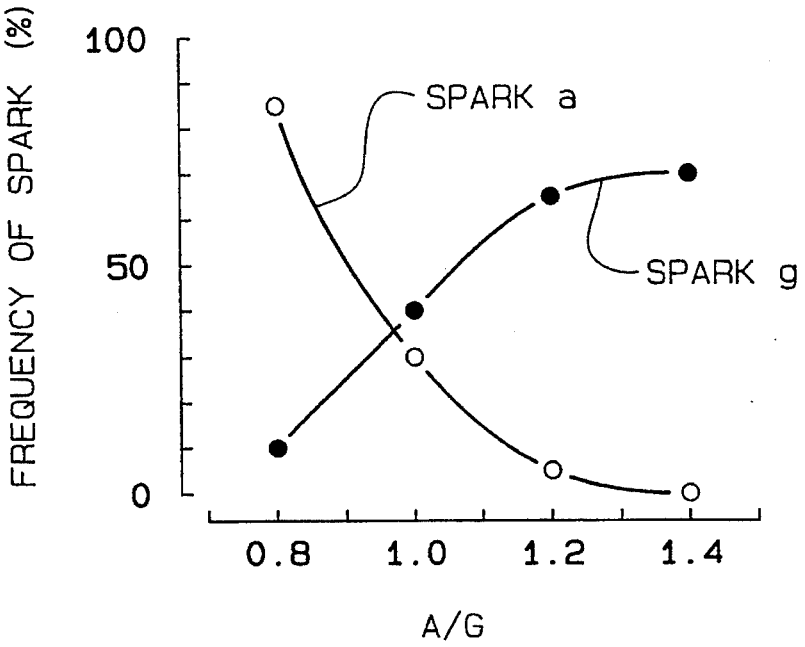
FIG. 7 is a graph showing the relation between the ratio (A/G) of the minimum gap A to the spark gap G and the spark frequency in the second embodiment.

The result is shown in FIG. 7. As can be seen from the figure, the frequency of the spark g increased and the frequency of the spark a decreased, as the value of A/G increased. In other words, the frequency of the spark g increased as the distance of the minimum gap A increased in comparison to that of the spark gap G. When the minimum gap A was 1.2 times or more wider than the spark gap G, the spark a almost disappeared, where the frequency of the spark g reached almost maximum.

By analyzing the result more closely, it is found that the spark g occurs near the tip end of the center electrode 1. Therefore, when the spark plug is installed in a combustion chamber, the tip end of the center electrode 1 is open toward the center of the combustion chamber.

This increases the accessibility of the spark g to the air-fuel mixture. Also, since the spark g is close to the center of the combustion chamber, the flame easily spread to the rest of the chamber.

Thus, the increased frequency of the spark g is considered to improve the ignition performance of the spark plug.

On the other hand, since the flame seed produced by the spark a is surrounded by the center electrode 1 and the ground electrodes 21 and 22, the flame seed is not easily accessible to the air-fuel mixture and, thus, difficult to expand.

Even if the flame seed expands, the flame hardly spreads to the rest of the combustion chamber since the position of the spark a is distant from the center of the combustion chamber, resulting in a low ignition performance.

THIRD EMBODIMENT

In this embodiment, the relation between the minimum gap B between the discharge face of the ground electrode and the tip face of the insulator, and the spark gap G between the discharge face and the noble metal piece was analyzed.

The analysis was conducted by applying conductive paste to the tip face of the insulator 4 and baking it to form an electric channel between the center electrode and the tip face of the insulator, in order to reproduce a condition where carbon has adhered to the tip face of the insulator. The minimum gap B and the spark gap G are set equally.

Using this setup, the spark plug was discharged under the same conditions as in second embodiment above.

As a result, no spark occurred at the minimum gap B. Sparks frequently occurred at the spark gap G. It is considered that since the electric field is weak at the tip face of the insulator 4 because the tip face of the insulator 4 is flat or in a smooth convex shape with a large radius of curvature, spark at the minimum gap B does not occur even when B=G.

FOURTH EMBODIMENT

In this embodiment, the relation between the ratio (A/G) of the minimum gap A to the spark gap G and the ignition performance of the spark plug was analyzed.

Figure 8:
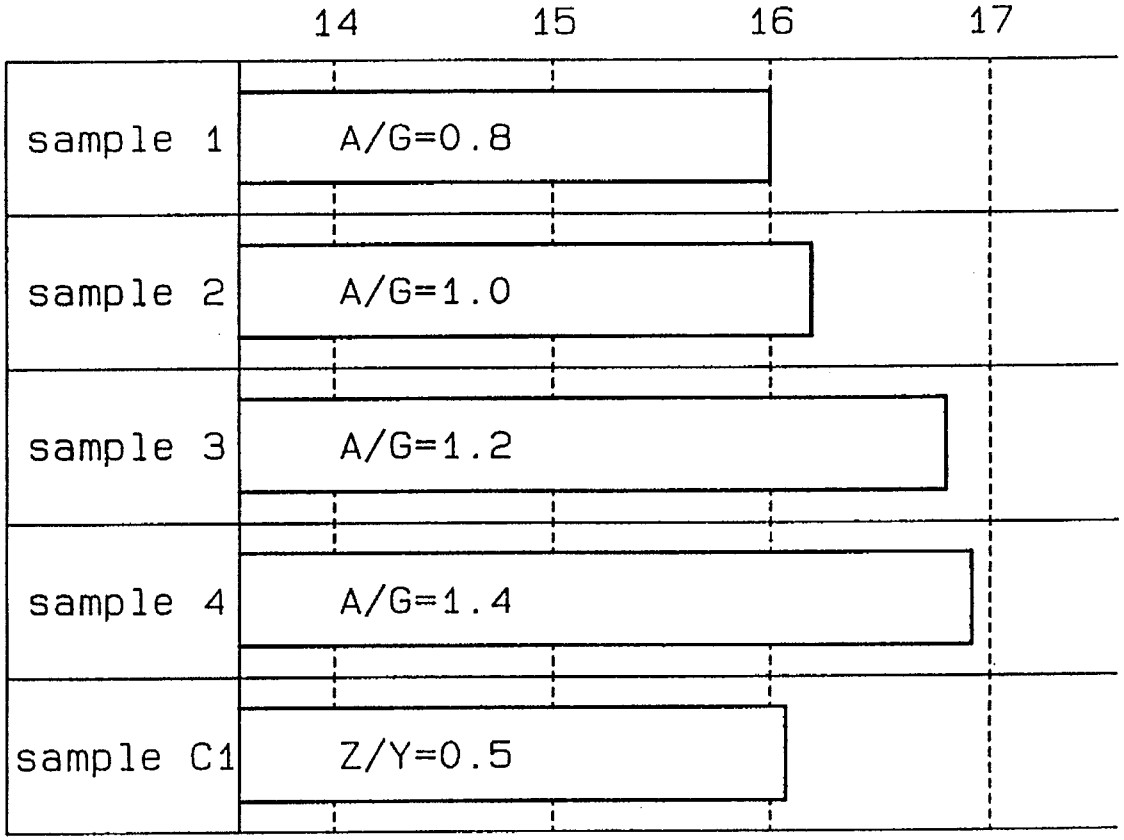
FIG. 8 is a diagram showing the relation between the ratio A/G of the minimum gap A to the spark gap G and the lean burn limit in a fourth embodiment.

The minimum gap A between the discharge faces 211 and 221 of the ground electrodes 21 and 22 and the inclined faces 101 and 102 was varied in the range of 0.8 to 1.4 mm, to change the ratio (A/G) of the minimum gap A between the discharge face and the inclined face to the spark gap G between the discharge face and the noble metal piece, as shown in FIG. 8 (samples 1 to 4). The spark gap G was 1.0 mm and the minimum gap B between the discharge face and the tip face of the insulator 4 was 2.4 mm.

The dimensions and materials of the center electrode 1, noble metal pieces 31 and 32, and the ground electrodes 21 and 22 were the same as in the spark plug in first embodiment above. The center electrode 1 , noble metal pieces 31 and 32, and the ground electrodes 21 and 22 were assembled into NIPPONDENSO CO., LTD's PK20R spark plug.

As measuring conditions, a water-cooled, 4-cylinder, 1500 cc, 4-stroke cycle engine was operated at an idling speed of 650 rpm. Air-fuel mixture was lead to the spark plug, while varying the air-fuel ratio to the leaner side slowly. The air-fuel ratio where the engine combustion starts to misfire was defined as the lean burn limit. When the engine misfires, the hydrocarbons (HC) in the gasoline directly is discharged with the exhaust gas. The lean burn limit can be determined by detecting these components.

Figure 16:
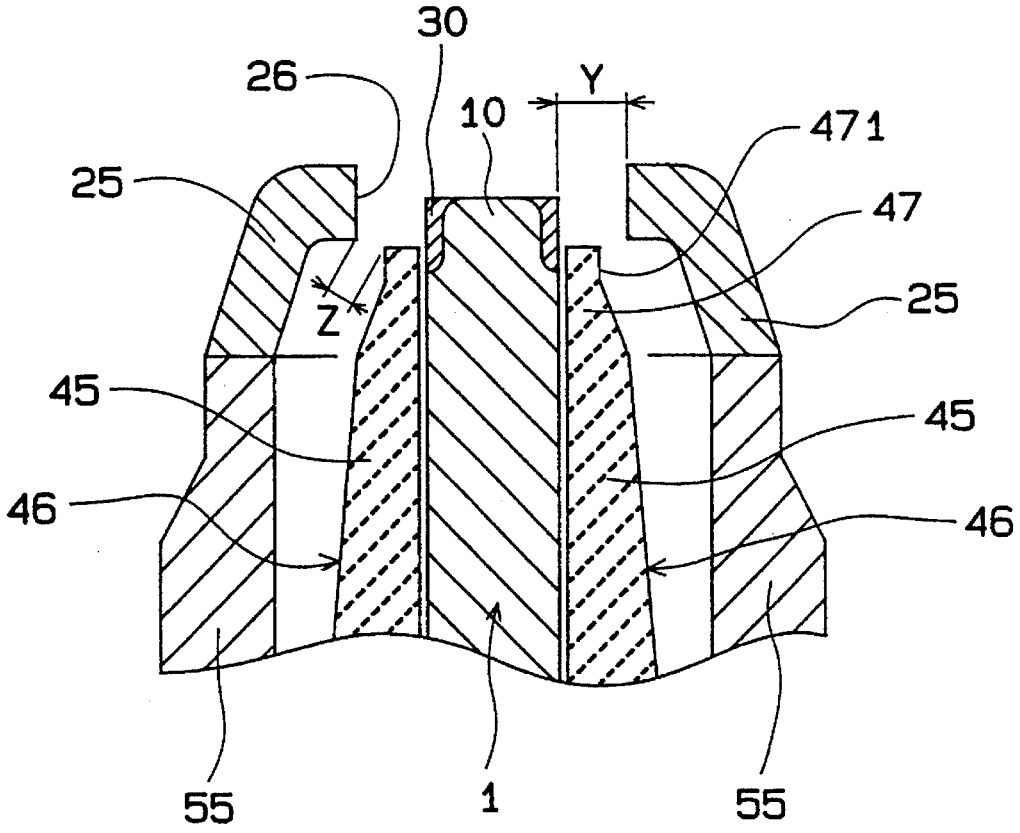
FIG. 16 is a partially cross sectioned side view of the principal part of a spark plug in other prior art.

As a comparison, the same measurement was also taken by using the conventional spark plug stated in Japanese Patent examined Publication No.3-50396 described as an example of the related art, as sample C1. This conventional spark plug has the dimensions relative to those of the spark plug of the first embodiment G=Y=1.0, A=B=Z=0.5, and A/G=0.5 (see FIG. 16)

The results of the measurements are shown in FIG. 8.

As can be seen from the figure, the air fuel ratio was about 17 when A/G was 1.2 or higher (samples 3 and 4). On the other hand, the air fuel ratio at the lean burn limit was about 16 in sample 1 and sample C1.

From these results, it is found that lean air-fuel mixtures can ignite when the ratio (A/G) of the minimum gap A to the spark gap G is 1.2 or higher.

FIFTH EMBODIMENT

In this embodiment, the relation between the form of the flat face and the peeling of the noble metal piece due to oxidation was analyzed.

A water-cooled, 6-cylinder, 4-stroke cycle, 2000 cc engine was operated for 100 hours in cycles of 1 minute at an idling speed and 1 minute at 5000 rpm (maximum load), to expose the spark plug to a heat stress.

The same spark plug as in the first embodiment was used. The axial length of the flat face L and the area S of the cross section perpendicular to the flat face were varied, to test with various forms of center electrodes.

The noble metal piece attached to the center electrode was formed of 78 wt % Pt-20 wt % Ir-2 wt % Ni alloy.

Figure 9:
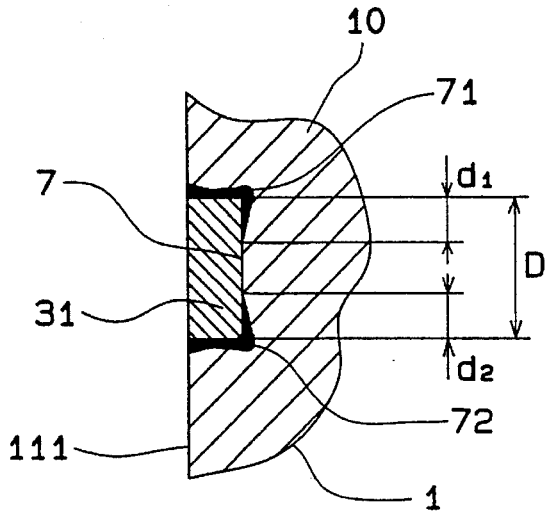
FIG. 9 is a schematic diagram showing the peeling state due to oxidation in the contact surface between the center electrode and the noble metal tip in a fifth embodiment.

As shown in FIG. 9, the spark plug after the start of engine operation occurs peeling 71 and 72 due to oxidation at the contact surface 7 between the noble metal piece 31 and the center electrode 1 in some cases.

Figure 10:
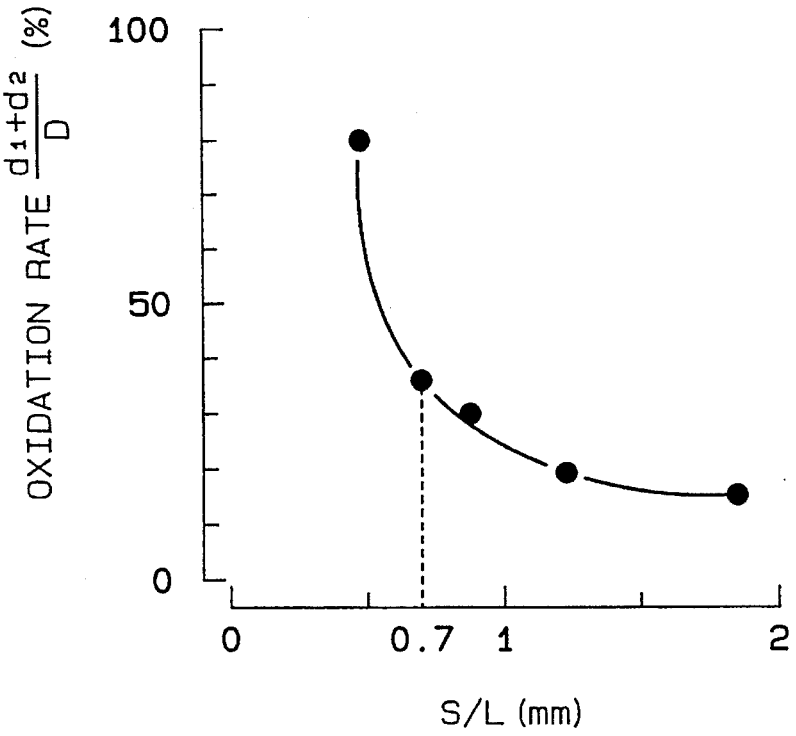
FIG. 10 is a graph showing the relation between the ratio S/L of the area S of a cross section perpendicular to the flat face to the axial length L of the flat face and the oxidation rate in the fifth embodiment.

The relation between S/L and the oxidation rate is shown in FIG. 10. The oxidation rate is defined as the percentage ratio of the length (d1+d2) of the peeling due to oxidation to the diameter D of the noble metal piece 31 as shown in FIG. 9.

As can be seen from the figure, when S/L is 0.7 or greater, the oxidation rate of the contact surface was lower than about 35%; when S/L was smaller than 0.7, the oxidation rate suddenly increased.

The result was interpreted as follows:

The contact surface between the flat face 111 of the center electrode 1 and the noble metal piece 31 receives a heat stress when heated. This heat stress is smaller when the maximum temperature of the contact surface is low. The maximum temperature of the contact surface 7 depends on a balance between the heat received from the air-fuel mixture during heating and the heat conduction in the axial direction of the center electrode 1, i.e., from the tip of the center electrode to the cavity 40 of the insulator 4.

If a center electrode 1 easily conducts received heat along its axis, the center electrode 1 can decrease heat stress at the contact surface 7, even if the center electrode 1 receives a lot of heat from the air-fuel mixture.

According to the general law of heat conduction, the heat conductivity in the flat face of the center electrode 1 shows higher value if the area S of a cross section perpendicular to the flat faces is larger and the axial length L of the flat faces is smaller.

Thus, assuming that the heat received from the air-fuel mixture is constant, the maximum temperature of the noble metal piece becomes lower if S/L becomes greater, and the heat stress in the contact surface is reduced. Therefore, the oxidation of the contact surface can be prevented if S/L is 0.7 or greater.

Based on this consideration, it can be seen that if $S/L \geqq 0.7$, peeling due to oxidation can be suppressed to a small extent, preventing the noble metal piece from falling off. Consequently the life of the spark plug is prolonged.

In utilizing a noble metal piece formed of 80 wt % Pt-20 wt % Ir alloy, the result was also the same.

SIXTH EMBODIMENT

Figure 11:
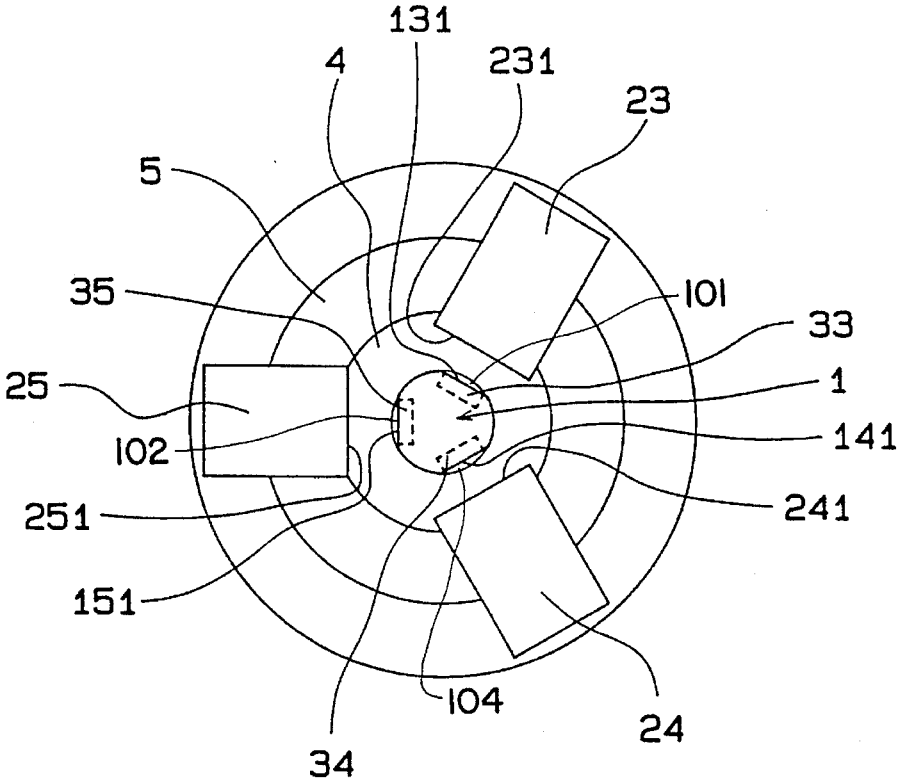
FIG. 11 is a plan view of the spark plug in a sixth embodiment.
Figure 12:
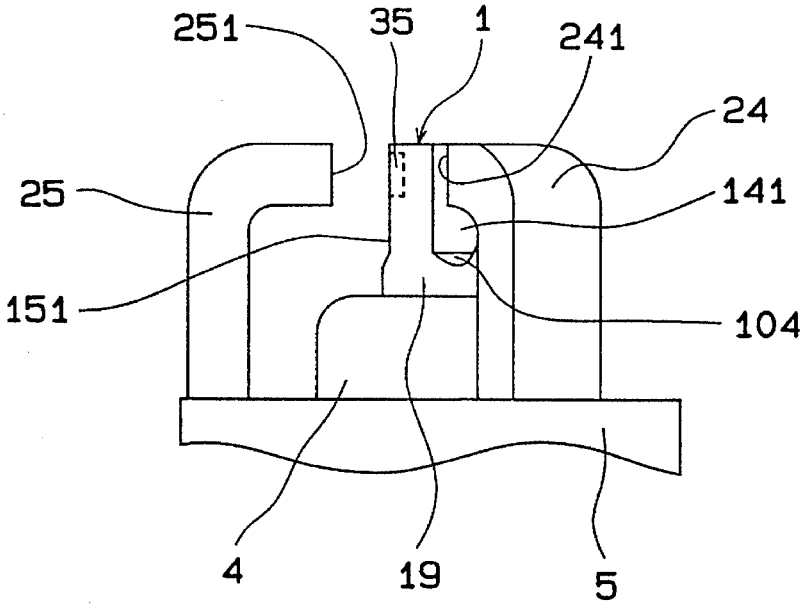
FIG. 12 is a partial side view of the spark plug in the sixth embodiment.
Figure 13:
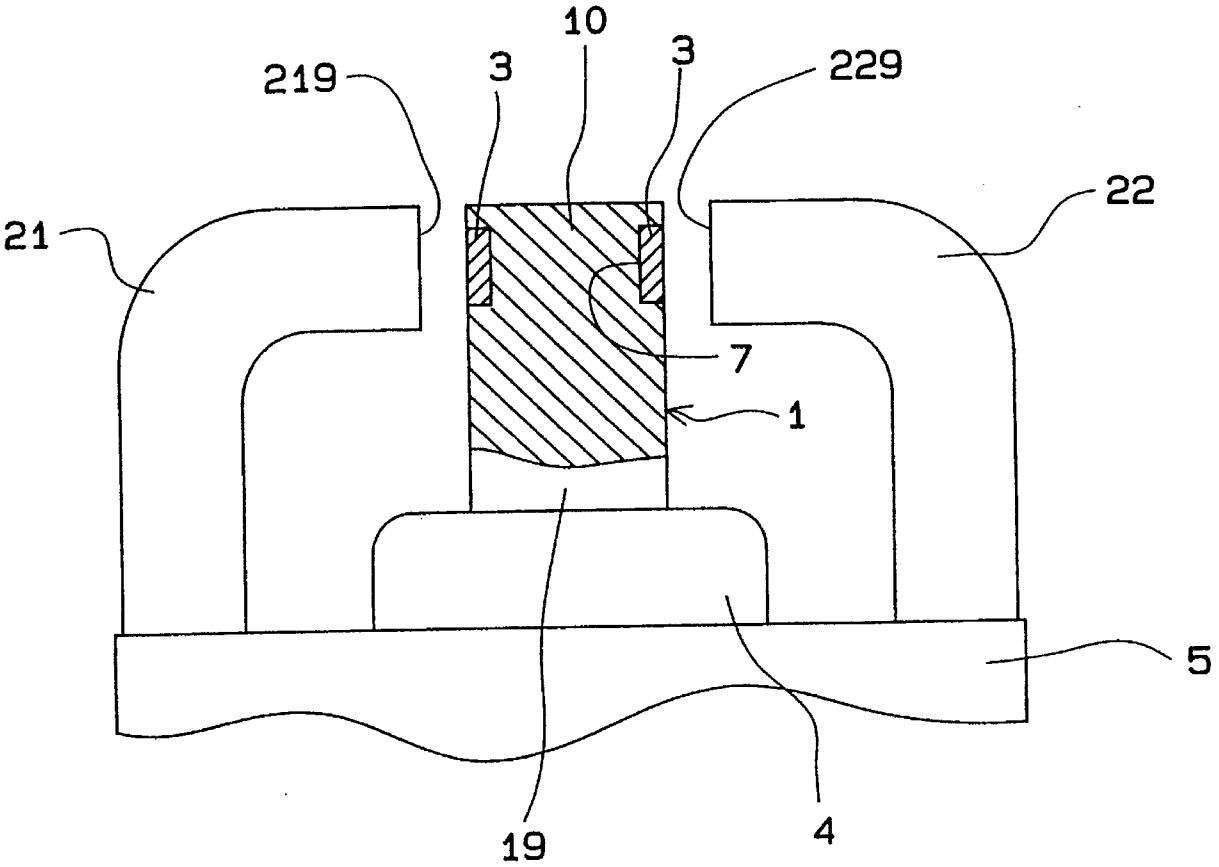
FIG. 13 is a partially cross sectional side view of the principal part of a spark plug in prior art.
Figure 14:
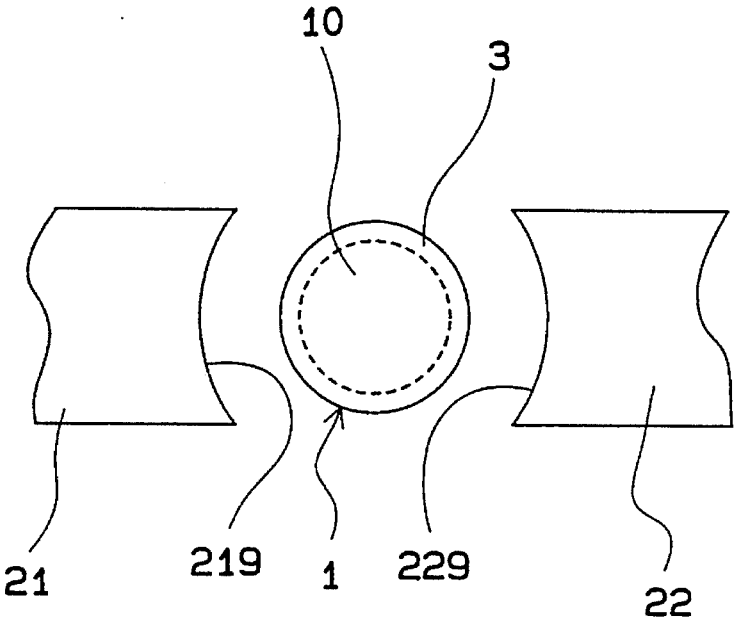
FIG. 14 is a plan view of the spark plug in prior art.
Figure 15:
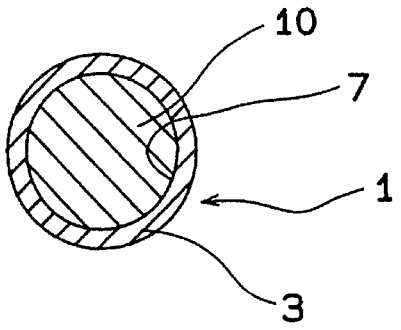
PRIOR ART FIG. 15
FIG. 15 is a horizontal cross sectional view of the tip of the center electrode of the spark plug in prior art.

The spark plug in this embodiment has a center electrode 1 with three flat faces 131, 141 and 151, and ground electrodes 23, 24 and 25 opposed to the three flat faces 131, 141 and 151, as shown in FIGS. 11 and 12. Flat noble metal pieces 33, 34 and 35 are resistance-welded to the flat faces 131, 141 and 151 at the positions opposed to the discharge faces of the ground electrodes 23, 24 and 25.

The center electrode 1 has an inclined face 104 which extends from the flat face 141 to the base 19. Inclined faces also extend from the flat faces 131 and 151 to the base 19, although they are not shown in the figure.

Other features are the same as in the first embodiment.

This embodiment has the same effect as the first embodiment.

What is claimed is:

1. A spark plug for igniting compressed air-fuel mixture of an internal combustion engine comprising:

an insulator;

a first electrode protruding from an end of said insulator, and having a free end face, said first electrode having a flat face defined on a surface thereof and extending toward said free end face in an axial direction of said first electrode, a base having an outer circumferential surface and a connecting portion for connecting said outer circumferential surface of said base and said flat face;

a housing secured in surrounding relation to said insulator;

a second electrode attached to said housing such that a tip face of said second electrode is opposed to said flat face of said first electrode;

a noble metal piece secured to said flat face of said first electrode so as to form a spark discharge gap between itself and said tip face of said second electrode;

wherein if said spark discharge gap is defined as G, and a minimum gap between said tip face of said second electrode and said connecting portion of said first electrode is defined as A, and a minimum gap between said tip face of said second electrode and said end of said insulator is defined as B, a distance of said gaps A, B and G satisfy the following relations:

the distance of A≧1.2×the distance of G; and the distance of B≧the distance of G.

2. A spark plug for igniting compressed air-fuel mixture of an internal combustion engine according to claim 1, wherein said first electrode has two flat faces formed in parallel.

3. A spark plug for igniting compressed air-fuel mixture of an internal combustion engine according to claim 1, wherein said first electrode having a cross-section of approximate triangular shape along a given distance from said free end face, so that three flat faces are formed on said first electrode.

4. A spark plug for igniting compressed air-fuel mixture of an internal combustion engine according to claim 1, wherein an axial length of said flat face of said first electrode is defined as L, and an area of a perpendicular cross section on said flat face is defined as S, a relation S/L≧0.7 is satisfied.

5. A spark plug for igniting compressed air-fuel mixture of an internal combustion engine according to claim 1, wherein said noble metal piece is embedded in and attached to said flat face of said first electrode in such a manner to align the external surface of said noble metal piece and said flat face in the same plane.

6. A spark plug for igniting compressed air-fuel mixture of an internal combustion engine according to claim 1, wherein said first electrode has three flat faces extending in the axial direction of said first electrode from said free end face, and further comprising second and third second electrodes, tip faces of said three second electrodes respectively opposing said three flat faces.

7. A spark plug for igniting compressed air-fuel mixture of an internal combustion engine, comprising:

an insulator;

a first electrode protruding from an end of said insulator and having a free end face, said first electrode having two parallel flat faces extending for a given distance from said free end face in an axial direction of said first electrode, a base having an outer circumferential surface and at least one connecting portion for connecting said flat faces and said outer circumferential surface of said base;

a housing secured in surrounding relation to said insulator;

two second electrodes attached to said housing, a tip face of each said second electrode facing toward a respective said flat face so as to oppose said flat face on a side of said first electrode;

a noble metal piece secured to each of said flat faces on said first electrode, so as to form a spark discharge gap between said noble metal piece and said tip face of said respective second electrode;

wherein if said spark discharge gap is defined as G, a minimum gap between said tip face of one said second electrode and said connecting portion of said first electrode is defined as A, and the minimum gap between said tip face of one said second electrode and said end of said insulator is defined as B, a distance of said gaps A, B and G satisfy the following relations:

the distance of A≧1.2×the distance of G; and the distance of B≧the distance of G.

8. A spark plug for igniting compressed air-fuel mixture of an internal combustion engine according to claim 7, wherein said noble metal piece is embedded in and attached to said flat face of said first electrode in such a manner to align the external surface of said noble metal piece and said flat face in the same plane.

9. A spark plug for igniting compressed air-fuel mixture of an internal combustion engine comprising:

an insulator having a first end and a second end;

a center electrode having a cylindrical shape secured to said insulator and protruding from said first end of said insulator, and having a free end face, said center electrode having a thinned portion extending for a predetermined distance toward said free end face, said thinned portion including a flat face;

a terminal secured to said second end of said insulator and electrically connected to said center electrode;

a metallic housing secured in surrounding relation to said insulator;

a noble metal piece secured to said flat face of said center electrode; and a ground electrode having a third end and a fourth end, said third end being electrically connected to said housing, and said fourth end being opposed to said noble metal piece secured to the flat face of said center electrode with a spark discharge gap there-between;

wherein if said spark discharge gap is defined as G, and a minimum gap between said fourth end of said ground electrode and a connecting portion between said flat face and an outer circumferential surface of said center electrode between said flat face and said insulator is defined as A, and a minimum gap between said fourth end of said ground electrode and said end of said insulator is defined as B, a distance of said gaps A, B and G satisfy the following relations:

the distance of A≧1.2×the distance of G; and the distance of B≧the distance of G.

10. A spark plug for igniting compressed air-fuel mixture of an internal combustion engine according to claim 9, wherein said noble metal piece is embedded in and attached to said flat face of said center electrode in such a manner to align the external surface of said noble metal piece and said flat face in the same plane.

* * * * *